United States Patent [19]

Hochstim

[11] Patent Number: 4,674,753

[45] Date of Patent: Jun. 23, 1987

[54] BOARDLESS MAZE GAME

[76] Inventor: Richard Hochstim, 8015 SW. 107 Ave., Apt. 107, Miami, Fla. 33173

[21] Appl. No.: 825,748

[22] Filed: Feb. 3, 1986

[51] Int. Cl.[4] ..... A63F 3/00; A63F 1/02; A63F 9/06; A63B 71/00

[52] U.S. Cl. ..... 273/258; 273/148 A; 273/156; 273/283; 273/294; 273/284

[58] Field of Search ..... 273/275, 283, 284, 292, 273/294, 153 R, 148 A; D21/42, 47, 55

[56] References Cited

U.S. PATENT DOCUMENTS

| | | | |
|---|---|---|---|
| 139,928 | 6/1873 | Stevens | 273/294 |
| 4,241,921 | 12/1980 | Miller | 273/148 A |
| 4,614,344 | 9/1986 | O'Connor | 273/283 |

FOREIGN PATENT DOCUMENTS

| | | | |
|---|---|---|---|
| 9994 | of 1897 | United Kingdom | 273/292 |

*Primary Examiner*—Richard C. Pinkham
*Assistant Examiner*—Benjamin Layno
*Attorney, Agent, or Firm*—Robert J. Van Der Wall

[57] ABSTRACT

A boardless maze game is disclosed. The game is played on any suitable and substantially flat surface. Apparatus comprises a deck of 28 "L" shaped playing pieces, a deck holder for holding a deck of stacked playing pieces and a plurality of identifying markers. The playing pieces are marked with a heavy border to define a wall. The heavy border is interrupted in three places to define an exit. The playing pieces are marked on both sides, with one side being a mirror image of the other, so that the playing piece may be turned over and played on either side. A maze is constructed from the playing pieces, the maze being started by the placement of a first playing piece upon the playing surface by the first player in turn. The object of the game is to move a marker so as to escape from the maze through an exit as the construction of the maze continues. Rules are provided covering the playing of the game and include rules for team playing and match playing. The game also includes the occurrence or construction of "courtyards" and applicable rules are also provided therefor.

7 Claims, 9 Drawing Figures

BOARDLESS MAZE GAME

FIELD OF THE INVENTION

The present invention relates to games and more particularly to a boardless maze game in which a maze is constructed from a plurality of playing pieces and the respective positions of players are indicated by the use of a plurality of identifying markers.

BACKGROUND OF THE INVENTION

The present invention presents a challenging game of skill and strategy in which players take turns in building a maze by the addition of "L" shaped pieces, and moving an identifier marker through the maze path, to indicate the position of the individual player within the maze. This game may be played by two, three or four players. The two and three player games are played individually; the four player game is played by two teams of two players. The object of the game is for one of the players to escape from the maze, and the first player or team to do so is the winner.

Apparatus for playing the game consists of: 28 "L" shaped maze pieces, and four identifying markers, such markers to be used to indicate the various positions of the players within the maze. A playing board is rendered unnecessary and the game may be played on an ordinary table top or any other flat surface that is large enough to accomodate the maze constructed during the course of the game.

Each of the 28 playing pieces is formed to present three squares of equal size. A border is marked around the perimeter of the playing piece, defined by a heavy line. The heavy line is continuous along the outside edge of each of the pieces to further define five closed sides, but is interrupted on three of the sides, thereby defining three exit openings. This is to permit the continuation of a maze. The playing pieces are marked on both sides, one side being a mirror image of the other side. This permits the playing piece to be used in two ways simply by turning the playing piece over to expose the other side. No two playing pieces are alike and each one represents one of only 28 possible configurations.

When adding a piece to the maze, a player must always bear in mind two requirements: (1) At least two borders of the piece must be in contact with the maze, and (2) at least one defined exit on the piece must be joined to an exit on the existing maze, but may not be placed in such a manner as to close off the last remaining exit out of the maze.

In addition to the previously described apparatus of the game, an optional deck holder is provided for retaining the unplayed game pieces in an orderly stack from which the various players can draw pieces in turn.

To begin a game, each player selects an identifying marker. The playing pieces are stacked into a deck. The deck is cut, restacked, shuffled and may be placed on the holder. Three or four playing pieces are then dealt to each player, the number of pieces depending on the number of players in the game. Thus, if there are two players, each player receives four pieces. If there are three or four players, each player receives three pieces.

The player first in turn begins the formation of the maze by selecting one of the pieces dealt to this player and places it at the center of the playing surface. The first player then enters the maze by placing a marker on one of the squares of this piece to establish a position within the forming maze. The other players take turns in a clockwise direction around the playing surface, add one of the pieces dealt to them to the maze, and place a marker to indicate their positions within the maze.

Players now set aside the pieces dealt to them for later use in the game. Each piece set aside must be clearly visible to all players.

In the second turn, each player, in turn, plays two pieces from the deck, adding these pieces to the maze. The two pieces must be played in sequence, i.e., the first piece must be added to the maze before the second one is removed from the deck.

On the third turn and all subsequent turns until the deck is depleted, each player plays two pieces sequentially from the deck and afterwards must move the identifying marker two steps, with a step being defined as a move from one adjacent square to another. Diagonal movement is not permitted.

When the deck has been depleted, the pieces previously set aside by the players may be used. The use of the pieces is optional with the players. A player may use one of the pieces to add to the maze, per turn, or may withhold a piece for later play in the game, but a two step move of the marker is required regardless of whether or not a piece has been played in turn.

The game continues until a player or team escapes from the maze at which point the game ends. The escaping player, or team, is the winner of the game. It must be noted that when playing as a team, both members of the team must escape from the maze to end the game.

Although much novelty is found in the foregoing description, it is also noteworthy to consider the novel compactness of the apparatus of the present invention which can literally be stored in a container of about the size of a package of cigarettes, and yet when played, results in a maze with a total area of approximately 84 square inches when all pieces are used, assuming a side dimension of a playing piece is one inch.

The novelty of the present invention becomes even more apparent after examination of references disclosed by a recent patent search of the prior art.

U.S. Pat. No. 4,180,271 by McMurchie teaches a game which, unlike the present invention, uses a game board. Square tiles with straight and curved lines are drawn from a deck and added to the playing board or grid. Each player starts forming a line at the edge of the board and has an identifying piece which rests on this line segment. During a turn, a player chooses one of the tiles in a hand, as in card games, and adds it to his line in such a way as to increase the length of the line. The player then advances the identifying piece to the end of the line. If at any time, the forward end of the line touches the edge of the playing board, the player is eliminated from the game. The object of the game is to remain in the game until all other players have been eliminated. Both the method and object of the game are very different from the present invention and do not anticipate the present invention in any respect.

A reading of U.S. Pat. No. 3,643,956 by Bovasso teaches a game that employs a plurality of identically marked square cards played, as in McMurchie, on a playing board. The object of the game is to extend a line from one end of the board to the opposite end, or to form a continuous loop, quite unlike the present invention.

An additional dissimilar game plan is disclosed in U.S. Pat. No. 3,741,545 by Weisbecker wherein a playing board has a pattern of squares protruding from a molded board and pieces of various shapes are inserted between the molded squares to form a surface route that intersects with the squares. The object of the game is to move a marker on the route from one corner to another on the playing board.

Another reference is German Pat. No. 801435 by Schulle. The disclosure here is really not a formulated game, but rather a mechanical device that can be used to construct a variety of mazes. Essentially, it teaches a playing board consisting of a grid in which linear elements may be inserted to form the walls of a maze.

Somewhat similar to Schulle, is the teaching of U.S. Pat. No. 4,057,253 by Csoka, wherein a slotted playing board is used, and in which players build a maze which is concealed from other players. The players take turns guessing where to enter the opponent's maze, and how to move through this maze. The object is to reach a designated square hidden in the maze of the opponent.

An interesting game is disclosed by U.S. Pat. No. 3,309,092 by Hardesty, which unlike the present invention, is another board game. Hardesty uses square tile with line segments marked thereon to form a "road route" when fitted together. A die is included and is cast by the players to determine movement on the playing board. The object is to get from one end of the playing board to the other on the "road" across the square tiles.

As shown by a review of the several references, it is quite apparent that the present invention represents a very unique and novel departure from the prior art. The novelty of the present invention will be further demonstrated in the rules and detailed description that follow.

SUMMARY OF THE INVENTION

With the foregoing in mind, it is a primary object of the present invention to provide an interesting game that does not require a playing board. In the absence of a playing board, the dimensions of a maze constructed by the various players are limited only by the number of playing pieces provided. This, therefore, permits a greater flexibility of play, and significantly increases the number of maze configurations that are possible.

In games using a playing board, the board constitutes a restraint by presenting definite boundaries to the players. In the present invention, the boundaries of the maze are constantly changing and it is never clear, until the end of the game, how close a player may be to the final "edge" where an escape from the maze may be accomplished. This makes the present invention a more intellectually challenging and interesting game as there is no clearly defined direction in which to move or boundary or position for which to strive, only to escape from the maze.

In the absence of a playing board, the present invention presents a very compact and portable form of game. The entire game apparatus can actually be stored in a container with an approximate size equal to a package of cigarettes, and yet, when the game is played, a maze can result with a total area of 84 square inches, assuming a one inch side dimension of the playing pieces.

The novel shape and marking of the playing pieces of the present invention provide an additional beneficial feature. The playing piece design not only provides a much greater range of possible positions within the maze by being marked on both sides and being usable in play on both sides, but it also serves to develop the visualization skills of the players because the players know in advance that the other side of a particular playing piece is marked with the mirror image of the side that is visible. Because of this unique piece design, a player has the intellectual challenge to visualize possible moves by an opponent as pieces are exposed on the drawing deck and also by a study of pieces held by other players which are to be used when the deck is depleted. This visualization also occurs because a player adds two pieces to the maze at each turn. Although these pieces are added sequentially, the player can see the second piece when he removes the first one from the deck, and can then visualize the use of either side of both pieces before the first one is played. It is to a player's advantage to coordinate the placements of his two pieces. He may take his first piece and add it to the maze in various positions, but to play effectively, he must look at the top surface of the following piece still in the deck, to determine how its placement may maximize the utility of his first piece. He must not only visualize the placement of the top surface of the piece still on the deck, but must also imagine its mirror image and the various orientations in which this mirror image may be added to the maze. Since he may not touch his second piece until he has settled on the final placement of his first piece, it is necessary for him to visualize and plan out the expected position of this second piece in his mind's eye. Of course, the same considerations are necessary after he removes his second piece from the deck and exposes the following piece which his opponent will play. An experienced player will evaluate the "damage" his opponent may inflict by playing this piece, and this information should be considered as he plays his second piece.

The present invention may be considered as a stepping stone to the development of a player's ability in two dimensional visualization. It also provides training in both probabilistic and analytical thought processes at different stages of the game. For example, while playing pieces from the deck, it is useful to anticipate the probability of a certain piece or group of pieces being drawn. After the deck is depleted and all pieces are exposed, though not yet played, a purely analytical thought process is necessary.

Accordingly, it is a primary object of the present invention to provide a novel game that is interesting, entertaining, and that serves to further the development of visualization and planning skills of individuals and groups of players.

It is a further object of the present invention to provide a maze game in which the maze is constructed with the actual elements of the maze, the playing pieces, rather than with linear elements being inserted in a playing board.

It is a still further object of the present invention to provide a maze game wherein the dimensions of a maze are not limited.

It is an additional object of the present invention to provide a maze game wherein a virtually unlimited number of different mazes are possible.

It is another object of the present invention to provide a maze game wherein the object of the game is to escape from a maze and further providing that points of escape are constantly changing and are not altogether evident until the end of the game.

It is still another object of the present invention to provide a maze game wherein the apparatus of the game is very compact and portable.

It is a still further additional object of the present invention to provide a maze game wherein a maze is formed simultaneously with movement through such maze.

It is an important object of the present invention to provide a playing piece that is marked for play on both sides, thereby increasing the challenge for visualization and planning, and adding to variety of playing possibilities.

It is another important object of the present invention to provide a maze game that is valuable in developing visualization and planning skills.

It is still another important object of the present invention to provide a maze game that requires probabilistic and analytical thought processes at various stages of the game.

It is still another important object of the present invention to provide the novel courtyard feature of the maze game.

It is still another important object of the present invention to provide for team playing and match playing.

It is an additional object of the present invention to provide a system of scoring.

Other objects and advantages will become apparent to those skilled in the art and the invention will be better understood after reading the following detailed description of the embodiments thereof with reference to the appended drawings, in which:

DETAILED DESCRIPTION

The object of the game is to escape from a maze. The first player or team of players to escape becomes the winner.

Figure 1:
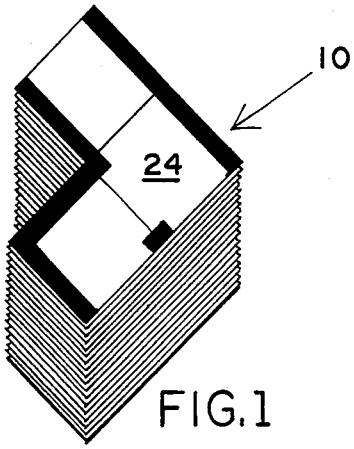
FIG. 1 is a perspective view of a stacked deck of playing pieces.

Referring to the drawings by characters of reference, FIG. 1 illustrates a stacked deck of playing pieces 10. The deck comprises 28 pieces, each piece being "L" shaped and having a heavily marked interrupted border on the perimeter.

Figure 2:
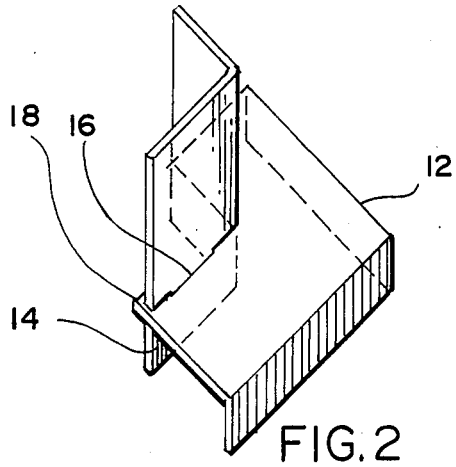
FIG. 2 is a perspective view of an optional deck holder showing a shelf to hold the deck of playing pieces and an upright support.

FIG. 2 illustrates an optional deck holder having the shelf 12 which is inserted into the slot 16 of the upright 14, the corner 18 protruding through upright 14. The deck of playing pieces 10 is placed upon the shelf 12 and against the upright 14 and players of the game may draw the playing pieces 24 therefrom.

Figure 3:
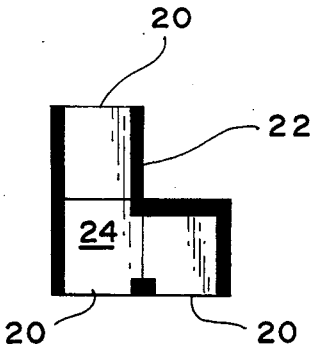
FIG. 3 is a plan view of a typical playing piece showing heavy border and openings therein.

The configuration and appearance of the playing piece 24 is shown in FIG. 3, which is a top planar view. The playing piece 24 is marked to define three equal square areas. The three square areas are defined by a light line between and having a heavy border line 22 on the perimeter edges. The heavy border 22 on the three squares defines five of the eight sides or walls 22, the heavy border 22 being interupted by the open areas 20 to define an opening or escape passage. Each playing piece 24 has three such escape passages 20. The arrangement of the heavy border "wall" and the escape passages 20 are differently disposed on each of the 28 playing pieces so that no two playing pieces are marked alike. Further, the playing pieces are so marked on both sides, one side being a mirror image of the other so that the playing piece may be turned over and can be used on either side at the option of the player.

Figure 5:
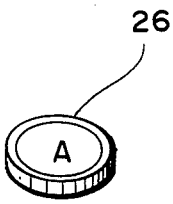
FIG. 5 is a perspective view of an identifying marker.

In order to identify the player and to distinguish one player from another, a marker 26 as shown in FIG. 5 is provided. A player must move this marker through the maze as the game progresses to establish a position in the game.

Figure 4:
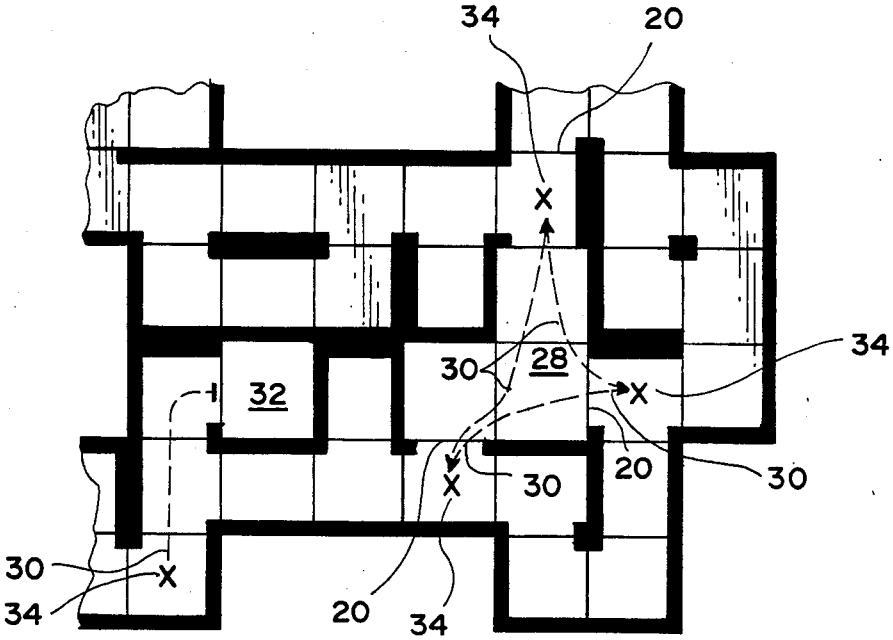
FIG. 4 is a top view of a portion of a constructed maze resting on a playing surface and illustrates an open courtyard and a closed courtyard.

A courtyard situation is illustrated in FIG. 4 and shows how a player can encounter a closed courtyard 32 or an open courtyard 28 when moving through a section of a maze that is substantially enclosed on all sides by the structure of the maze. A path of movement 30 shown in broken lines from an attained position 34 can lead to the closed courtyard 32 or to and through the open courtyard 28 during the course of a game. Rules applicable to a situation involving the courtyard will be explained in detail further on in this detailed description.

Figure 6:
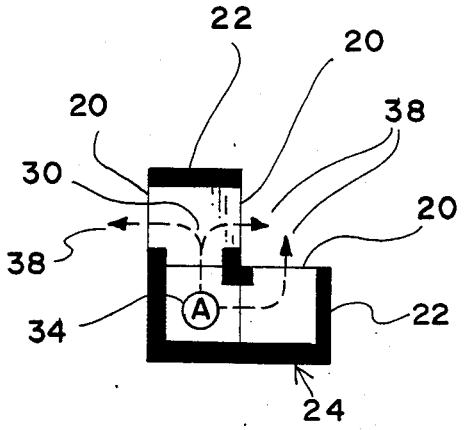
FIG. 6 illustrates the escape passages in a typical playing piece borders.

Certain restrictions apply during the first two turns of each player at the start of a game. FIGS. 6–9 illustrate these restrictions. FIG. 6 is a plan view of a playing piece at the beginning of a game. The playing piece 24, as in all of the playing pieces, has the three escape passages 20 open to the player A. The escape route of movement 30, shown in broken lines lead to the open escape passages 20 and player A may escape the maze at 38.

Figure 7:
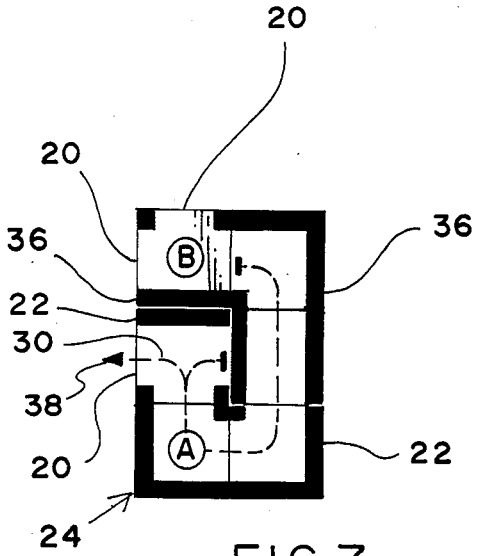
FIG. 7 shows a newly added playing piece that has two exits blocked by a marker and one remaining exit open.

FIG. 7 shows the playing piece 24, to which, the playing piece 36 has been attached by another player B. One escape passage is now blocked by the addition of piece 36, another by the marker of player B, but the third escape passage remains open at 38 and player A is able to move his marker in that direction.

Figure 8:
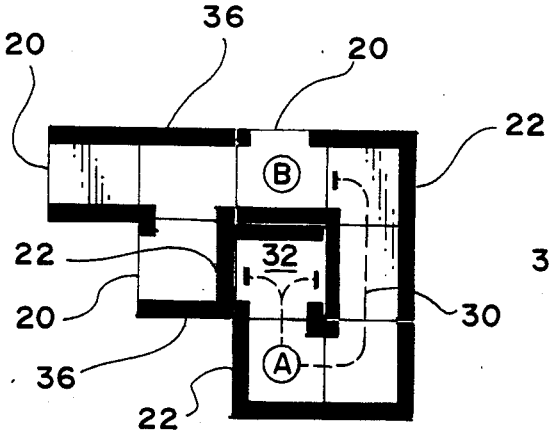
FIG. 8 illustrates the placement of a newly added playing piece that is prohibited during the first two turns of a game.

Although FIG. 7 illustrates a placement of a playing piece that is permitted by rules of the game, FIG. 8 illustrates a placement of the playing piece and marker that is prohibited by the rules. In FIG. 8, a newly added playing piece 36 has been added to the existing maze, but the wall 22 blocks a previously existing opening creating the blocked passage 32. In addition, the placement of marker B blocks access to escape passage 20, leaving no escape route available to player A. This rule applies only during the first two turns of a game. After the first two two turns have been completed by all players in the game, it is then permissible to close off all escape routes of another player.

Figure 9:
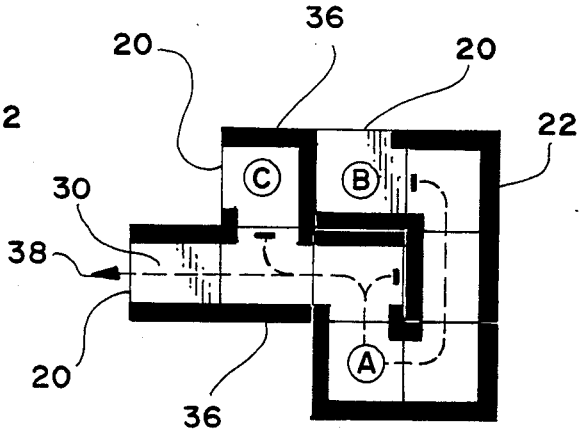
FIG. 9 illustrates how the newly added piece of FIG. 8 may be turned over and the reverse side positioned to provide an exit during the first two turns of a game.

FIG. 9 shows that by turning the playing piece 36 over and using the reverse side, the playing piece 36 may be added to the existing maze in a manner to open the previously closed wall of 32 (FIG. 8) and allow player A to escape at 38 although the other two escape passages 20 are blocked by the markers of player B and player C.

Again referring to the drawings by characters of reference, the playing of the present invention game and rules pertaining thereto are described as follows:

The game of the present invention may be played by two, three, or four players. Two and three player games are played individually while the four player games are preferably played by two teams of two players to each team.

The object of the game is to escape from the constructed maze and the first player or team to escape from the maze, becomes the winner of the game.

The playing apparatus comprises a deck of 28 double-faced playing pieces (see FIG. 1), an optional holder for the deck of pieces (see FIG. 2) and four identifying markers (see FIG. 5).

The game may be played and the maze constructed on any suitable and substantially flat surface. A game board is not used.

In preparation to play a game, each player selects an identifying marker. The maze pieces are stacked into a deck and shuffled. The deck is then cut, restacked and placed upon the holder 12.

Three or four pieces from the deck 10 are then dealt to the players. The number of pieces dealt to each player depending on the total number of players in the game. In a two player game, each player receives four pieces. In a three player game, each player receives three pieces. In a four player team game, each player receives three pieces.

The player having first turn begins the maze by choosing one of the dealt pieces and placing it at the center of the playing area, and then enters the maze by placing a marker on one of the squares of the playing piece. The other players take turns in a clockwise direction around the playing surface, each player adding one of the playing pieces dealt to them, to the maze and also placing their markers on their respective pieces. There are two requirements for adding a piece to the maze:

1. At least two borders of the piece MUST be in contact with the maze.
2. At least one exit of the newly added piece MUST be joined to an existing exit of the maze.

During the first two turns of the players, no piece may be added to the maze in such a manner as to close off the last remaining exit from the maze (see FIG. 8).

After adding a first piece to the maze, all players set aside the remaining pieces dealt to them, for later use in the game. Each of the remaining pieces must be placed where they are clearly visible to all other players at all times.

After the first turn, each player, in turn, draws two pieces from the deck and adds these two pieces to the maze. The first piece so drawn in each turn must be added to the maze before the second piece may be drawn from the deck.

After the second turn is completed by all players, a player may close off the last remaining exit of an opposing player as shown in FIG. 8.

After the second turn, each player draws two pieces from the deck and also must move his identifying marker two steps. A step is defined as being equal to one of the three equal squares of the playing pieces. A move from one square to an adjacent square is considered to be one step.

Diagonal movement across the squares of the playing pieces is not allowed.

A marker is not allowed to pass by another player's marker nor may it occupy the same square occupied by another player's marker.

The playing of the game continues until an escape is made.

If the deck of playing pieces is depleted before an escape has been made, the players may add one, per turn, of the pieces that were set aside at the beginning of the game. A player has the option of playing one of the set aside pieces or to withhold the piece until later, but must in any event move the marker two steps. The game continues until a player escapes from the maze and at that point the game will end even though some pieces may not have been used.

Although the foregoing states that a player must move two steps, a move made by taking one step forward and then one step backwards to the previous position is prohibited and does not count as a two step move. A one step move is allowed when a player can escape the maze by a one step move. If escape or a two step move is not possible, then no movement is allowed.

As long as it is possible to play a piece drawn from the deck, without violating rules, such piece must be played. If it cannot be played, it is eliminated from play and set aside for the balance of the game. A player drawing such a piece that is eliminated from play does not receive a replacement for playing purposes.

In a three player game, the last piece in the deck is not used. It remains in the deck, however, so that no player may know in advance of its appearance which piece will be excluded from play.

Players may not use markers to obstruct the passage of an opponent's marker indefinitely.

If it is possible for a player to escape during a turn, he must do so and cannot take any action that prevents an immediate escape.

Turning now to FIG. 4 of the drawings, a unique situation is shown in the form of a "courtyard". A courtyard is an area of the playing surface which is exposed by the absence of a playing piece or pieces. A courtyard is completely surrounded by the maze structure, but due to the random construction of the maze, in the course of a game, none of the players should place a playing piece or pieces to fill this area or it is shaped so that no piece will fit. This is but one of the novel features of the present invention. Two types of courtyards may occur. An open courtyard has two or more exits on the perimeter. A closed courtyard has no exits. The players of a game may deliberately construct a courtyard but must bear in mind that rules previously mentioned apply also to a courtyard, that a piece added to the maze must have two borders touching the maze and an exit in direct contact with an exit of the maze.

FIG. 4 shows an open courtyard 28. A player positioned on X at 34 can move across the open courtyard via broken lines 30 to position X within the maze through opening 20. A player moving on broken line 30 to closed courtyard 32 is blocked and can forward no further.

A playing piece may be played in a courtyard.

Players cannot accomplish an escape by entering a courtyard.

Markers may not land in a courtyard but may jump across an open courtyard, regardless of its' size. A jump across an open courtyard counts as one step. Closed courtyards may not be jumped.

The rules for a team game are quite similar to two and three player games with some exceptions.

Each team is composed of two players taking alternate turns. Such turns are taken around the playing surface in a clockwise direction.

Before movement of markers begins, players must allow each member of an opposing team at least one clear exit from the maze. Teammates, need not do so among themselves.

To win a game, both members of a team must escape from the maze, but the first player of a team to escape may, on subsequent turns pass his turn by or do one or both of the following:

Add one piece to the maze.

Move the teammate's marker two steps.

After an escape, the marker of a player is placed on the playing surface next to the exit through which the escape was made. The teammate may pass through this exit, but members of the opposing team may not. The marker forms a blockade at this exit.

Pieces may not be added to a blockaded exit nor may a courtyard be formed surrounding such an exit.

Teammates may not exchange or play a partner's maze pieces.

After both members of a team escape the maze, the game ends and the escaping team is the winner.

Rules pertaining to a match play. Since a game requires a relatively short period of time, players may wish to engage in a match. A match may consist of any number of games. Before starting a match, players agree on the number games they wish to play. After each game, the first move of the next game is passed clockwise to the next player. During the match, a running total of each player is kept. At the conclusion of the match, the player or team with the best score is considered the winner of the match.

Scoring in the present invention game is similar to that used in golf games. The lower the players score, the better.

A player winning the game receives a score of 0. After escaping the maze, the escaped player's marker is placed next to the exit through the escape was made forming a blockade at this exit. The scores of other players remaining within the maze is determined by the minimum number of steps required for the remaining player to escape through the nearest exit other than the blockaded exit.

The maximum score that a player may receive, in any game, is limited to 25 steps. A player remaining in the maze at the end of a game will receive this score under any of the following conditions:

(1) When 25 or more steps are required to escape.

(2) When the only exit from the maze is blockaded.

(3) When the winning player escapes while playing from the deck.

Scoring method for a team game is very similar to the above. The winning team receives a score of 0. The score of the losing team is determined by adding together the individual scores of the team members.

If both members of a team remain in the maze, their score, as a team, is equal to the combined number of steps required for their escape. If only one member of the losing team remains in the maze, the number of steps required for the remaining member to escape determines the score of the losing team.

The maximum score a team may receive, per game, is limited to 25 steps. The losing team will receive this score under any of the following circumstances:

(1) When 25 or more steps are required to escape.

(2) When the only exit or exits from the maze are blockaded by members of the winning team.

(3) When both members of the winning team escape while playing from the deck.

Having described the presently preferred embodiments of the invention, it should be understood that various changes in construction and arrangement will be apparent to those skilled in the art and fully contemplated herein without departing from the true spirit of the invention. Accordingly, there is covered all alternatives, modifications and equivalents as may be included within the spirit and scope of the invention as defined in the appended claims.

What is claimed is:

1. A boardless maze game comprising:

a plurality of multi-cornered playing pieces, each of said plurality of multi-cornered playing pieces of equal size and shape, each of said plurality of multi-cornered playing pieces being marked with a mirror image on both sides thereof with a border line, said border line extending about the perimeter of each of said plurality of multi-cornered playing pieces, said border line being interrupted in three places, defining three exits through said border line;

said border line defining a maze when said plurality of multi-cornered playing pieces are assembled;

each of said plurality of multi-cordered playing pieces being individually distinguishable; and a plurality of individually distinguishable markers.

2. The game of claim 1 which further comprises:

a holder for unplayed pieces including a shelf;

upright support means; and structure to attach the shelf to the support means.

3. The game of claim 2 wherein the holder is collapsible by reason of the shelf being removably attached to the support means, the support means being constructed to be folded flat after being separated from the shelf, and the shelf also being a flat surface.

4. The game of claim 1 wherein said multi-cornered pieces are marked to include lateral lines extending from one border line to the opposite border line, said lateral lines defining three substantially square areas of substantially equal size, within the perimeter of said multi-cornered playing piece.

5. The game of claim 1 wherein said multi-cornered playing pieces are formed in a substantially "L" shaped configuration.

6. Apparatus as set forth in claim 1 wherein at least one of said exits of a multi-cornered playing piece may abut at least one of the exits of an adjacently placed multi-cornered playing piece to define a continuing maze pathway, said border line also abutting the border line of said adjacently placed multi-cornered playing piece to define an outer boundary of said pathway.

7. Apparatus as set forth in claim 6 wherein said maze pathway may continue in a random direction.

* * * * *